US008181492B2

(12) United States Patent
Yang et al.

(10) Patent No.: US 8,181,492 B2
(45) Date of Patent: May 22, 2012

(54) WASHING MACHINE WITH STEAM GENERATOR

(75) Inventors: Byoung Yull Yang, Suwon-si (KR); Sang Yeon Pyo, Suwon-si (KR); Jae Ryong Park, Hwaseong-si (KR); Tai Eun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1069 days.

(21) Appl. No.: 12/073,558

(22) Filed: Mar. 6, 2008

(65) Prior Publication Data

US 2008/0282750 A1 Nov. 20, 2008

(30) Foreign Application Priority Data

May 16, 2007 (KR) ..... 10-2007-0047451

(51) Int. Cl.
*B08B 3/12* (2006.01)
*D06B 23/00* (2006.01)
*D06F 37/00* (2006.01)

(52) U.S. Cl. ..... 68/5 C; 68/5 R

(58) Field of Classification Search ..... 68/5 C, 68/5 R

See application file for complete search history.

(56) References Cited

U.S. PATENT DOCUMENTS

| | | | | |
|---|---|---|---|---|
| 4,903,850 | A * | 2/1990 | Frank et al. | 392/403 |
| 5,536,375 | A * | 7/1996 | Vogelman | 203/2 |
| 2007/0006484 | A1 | 1/2007 | Moschuetz et al. | |

FOREIGN PATENT DOCUMENTS

| | | | |
|---|---|---|---|
| DE | 197 43 508 | | 4/1999 |
| EP | 0 816 550 | | 1/1998 |
| EP | 1 584 728 | | 10/2005 |
| EP | 1 666 655 | | 6/2006 |
| EP | 1813709 | A2 * | 8/2007 |
| EP | 1 900 865 | | 3/2008 |
| KR | 10-2006-096712 | * | 9/2006 |
| KR | 10-2006-0102952 | | 9/2006 |
| KR | 10-0712274 | * | 4/2007 |

OTHER PUBLICATIONS

KR 10-0712274; Apr. 2007; Jeon, G. D.; KIPO website machine translation.*
KR 10-2006-096712; Apr. 2005; Kim, H. S.; KIPO website machine translation.*
Extended European Search Report issued Sep. 18, 2008 in corresponding European Patent Application No. 08152563.6.
Chinese Office Action issued Dec. 21, 2010 in corresponding Chinese Patent Application 200810086768.X.
Office Action from Korean Patent Application 10-2007-0047451 dated Feb. 21, 2012.

* cited by examiner

*Primary Examiner* — Michael Barr
*Assistant Examiner* — Charles W Kling
(74) *Attorney, Agent, or Firm* — Staas & Halsey LLP

(57) ABSTRACT

Disclosed herein is a washing machine that is capable of generating hot air and steam to be supplied into a rotary tub using a single heater. The washing machine includes a rotary tub to receive laundry, a heating duct defining a channel to supply hot air to the rotary tub, a heater mounted in the heating duct, and a steam generating part heated by the heater to generate steam to be supplied to the rotary tub. The steam generating part includes an object heated by contacting the heater. The object includes a tubular member having an outer surface contacting the heater and a hollow part for steam generation defined therein. The object may include a steam generating plate having one surface contacting the heater.

26 Claims, 12 Drawing Sheets

PRIOR ART

PRIOR ART

WASHING MACHINE WITH STEAM GENERATOR

CROSS-REFERENCE TO RELATED APPLICATIONS

This application claims the benefit of Korean Patent Application No. 2007-47451, filed on May 16, 2007 in the Korean Intellectual Property Office, the disclosure of which is incorporated herein by reference.

BACKGROUND

1. Field

The present invention relates to a washing machine, and, more particularly, to a washing machine including a steam generator that is capable of supplying steam into a rotary tub.

2. Description of the Related Art

A washing machine is a machine that washes laundry using electric power. Generally, the washing machine includes a stationary tub to receive wash water and a rotary tub rotatably mounted in the rotary tub. When the rotary tub or a pulsator, mounted in the rotary tub, is rotated, while wash water and laundry are put in the rotary tub, dirt is removed from the laundry by friction between the laundry and the rotary tub and between the laundry and the wash water.

Recently, there has been proposed a washing machine that is capable of drying washed laundry and supplying steam to laundry in addition to a basic washing function, thereby improving the washing efficiency. In this case, the washing machine includes a drier and a steam generator. An example of the washing machine is disclosed in Korean Patent Publication No. 2006-0102952.

FIGS. 1 and 2 are a side sectional view and a plan view schematically illustrating the structure of the washing machine disclosed in the above Publication. As shown in FIGS. 1 and 2, the disclosed washing machine includes a drying duct 1 and a drying heater 2 to dry laundry. The drying duct 1 defines a channel to supply hot air into a rotary tub 3, and the drying heater 2 is mounted in the drying duct 1 to heat air to be supplied into the rotary tub 3. In addition, the washing machine includes a steam generator 4, which includes a steam generating part 4*a* and a steam heater (not shown) to allow steam washing to be performed. The steam generating part 4*a* is mounted to a machine body of the washing machine by an additional support bracket 5, and the steam heater is buried in the steam generating part 4*a* to heat the steam generating part 4*a*.

However, the conventional washing machine has a problem in that the drying heater 2, which heats air to generate hot air, and the steam heater (not shown; buried in the steam generating part), which heats water to generate steam, are individually included in the washing machine, thereby increasing the material costs. Furthermore, the drier, which includes the drying duct 1 and the drying heater 2, and the steam generating part 4*a*, in which the steam heater is buried, are separately mounted in the conventional washing machine. As a result, a large space is required to mount the additional parts of the washing machine, and the size of the washing machine is increased.

In addition, the steam generator 4 is exposed in the inner space of the conventional washing machine, with the result that components around the steam generator 4 may be damaged by high-temperature heat transmitted from the steam generator 4.

SUMMARY

Therefore, it is an aspect of the embodiments to provide a washing machine that is capable of generating hot air and steam to be supplied into a rotary tub using a single heater.

It is another aspect of the embodiments to provide a washing machine that is capable of preventing components around a steam generator from being damaged by high-temperature heat transmitted from the steam generator.

Additional aspects and/or advantages will be set forth in part in the description which follows and, in part, will be apparent from the description, or may be learned by practice of the invention.

The foregoing and/or other aspects are achieved by providing a washing machine including a rotary tub to receive laundry, a heater mounted on a channel to supply hot air to the rotary tub, and a steam generating part heated by the heater to generate steam.

The washing machine may further include a heating duct defining the channel.

The steam generating part may include an object heated by the heater.

The object may include a tubular member having an outer surface contacting the heater and a hollow part for steam generation defined therein.

The washing machine may further include a water supply pipe extending into the channel such that the water supply pipe is connected to the hollow part and a steam supply pipe having one end connected to the hollow part.

An other end of the steam supply pipe may extend to an outlet of the channel.

The tubular member may be provided at the outer surface thereof with heater receiving parts to partially receive the heater such that the contact area between the tubular member and the heater is increased.

The heater may include a first heater part and a second heater part, and the tubular member is located between the first heater part and the second heater part.

The heater may include two heat emission pipes, which are adjacent to each other, and the tubular member is inserted between the two heat emission pipes.

The object may include a steam generating plate having at least one surface heated by the heater.

The washing machine may further include a water supply pipe extending into the channel such that one end of the water supply pipe is located above the steam generating plate. In this case, a spray nozzle may be mounted to the end of the water supply pipe.

The steam generating plate may include heater receiving parts to partially receive the heater such that the contact area between the steam generating plate and the heater is increased.

The heater may include a first heater part and a second heater part, the bottom of the steam generating plate contacts the first heater part, and the steam generating plate includes bent parts bent toward the second heater part and heater support parts formed at the bent parts to support the second heater part.

The heater may include a plurality of heat dissipation fins, and the steam generating plate is mounted on the heat dissipation fins.

The washing machine may further include a blowing unit to supply hot air or steam to the rotary tub.

The foregoing and/or other aspects are achieved by providing a washing machine including a rotary tub, a heating duct connected to the rotary tub, a steam generating part disposed in the heating duct, and a heater to heat air in the heating duct such that hot air is supplied to the rotary tub, or to heat the steam generating part such that steam is supplied to the rotary tub.

The steam generating part may include an object to receive water to be heated, the object being heated by the heater.

The foregoing and/or other aspects are achieved by providing a washing machine including a rotary tub, a dryer having a heating duct and a heater mounted in the heating duct, the dryer supplying hot air into the rotary tub, a tubular object to be heated, which is mounted in the heating duct such that the object is heated by the heater, and a water supply pipe extending into the heating duct to communicate with the object.

The heater may include a first heater part and a second heater part, which are arranged in parallel to each other, and the object may be fixedly inserted between the first heater part and the second heater part.

The foregoing and/or other aspects are achieved by providing a washing machine including a rotary tub, a dryer, having a heating duct and a heater mounted in the heating duct, to supply hot air into the rotary tub, a plate-shaped object to be heated, which is mounted in the heating duct such that the object is heated by the heater, and a water supply pipe having one end located above the object.

The heater may include a first heater part and a second heater part, which are vertically arranged in parallel to each other, and the object may include a first part located at the first heater part and a second part extending upward from the circumference of the first part.

The heater may include a positive temperature coefficient (PTC) heater having a plurality of heat dissipation fins, and the object is mounted on the heat dissipation fins.

The washing machine may further include a support bracket mounted between the steam generating plate and the channel.

The foregoing and/or other aspects are achieved by providing a washing machine, including: a rotary tub to receive laundry; a heater supplying hot air to the rotary tub; and a steam generating object disposed adjacent to and heated by the heater to generate steam.

The steam generating object may include at least one heater receiving groove receiving a portion of the heater.

The at least one heater receiving groove may be disposed at a bottom or a top of the steam generating object.

The heater may include a plurality of fins, each of the fins being receivable into the at least one heater receiving groove.

The washing machine may further include a water supply pipe supplying water onto a surface of the steam generating object.

The water supply pipe may be disposed at one of a side of the steam generating object to supply water into the steam generating object or above the steam generating object to supply water onto at least one surface of the steam generating object.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
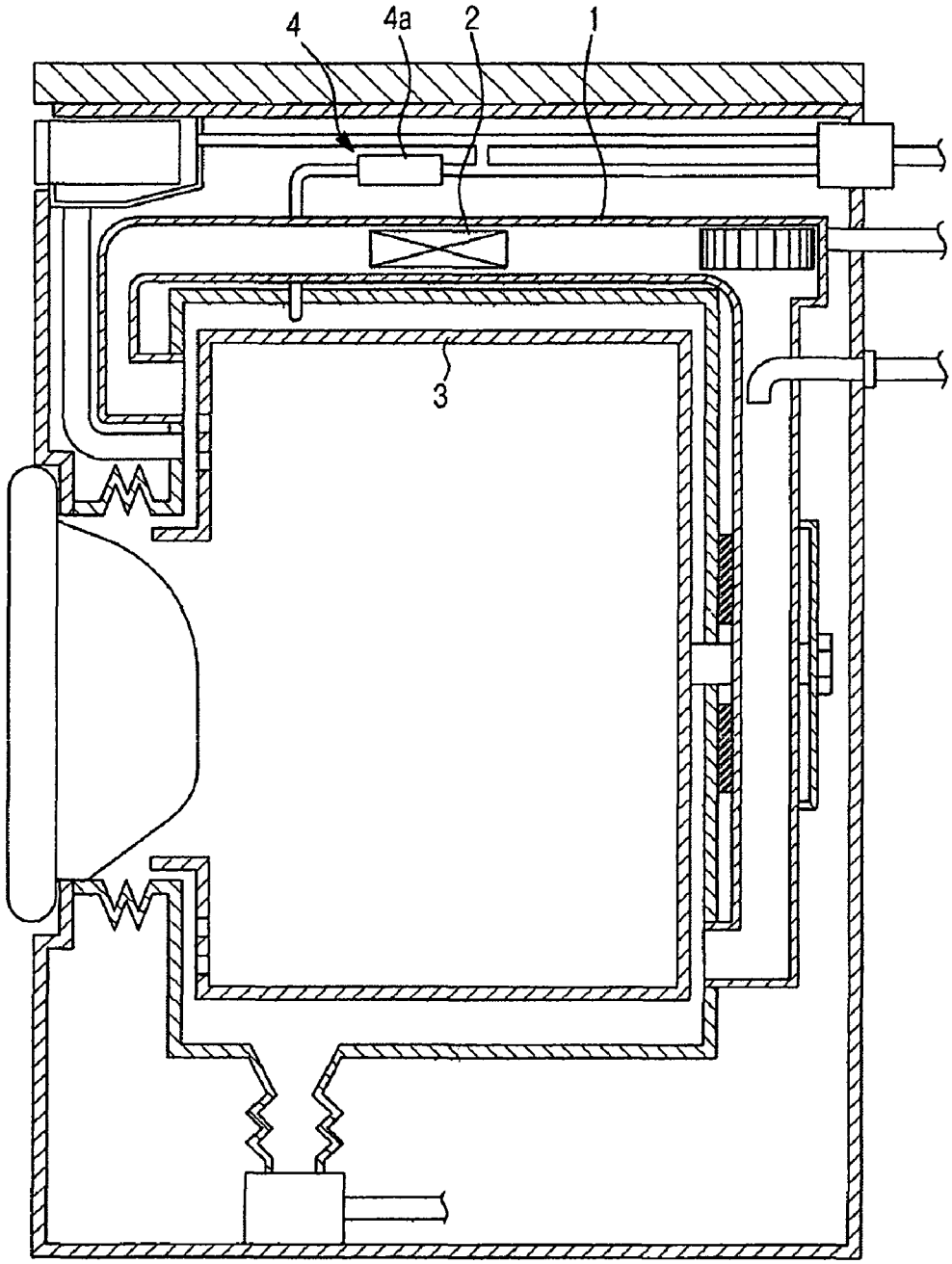
FIGS. 1 and 2 are a side sectional view and a plan view schematically illustrating the structure of a conventional washing machine.
Figure 2:
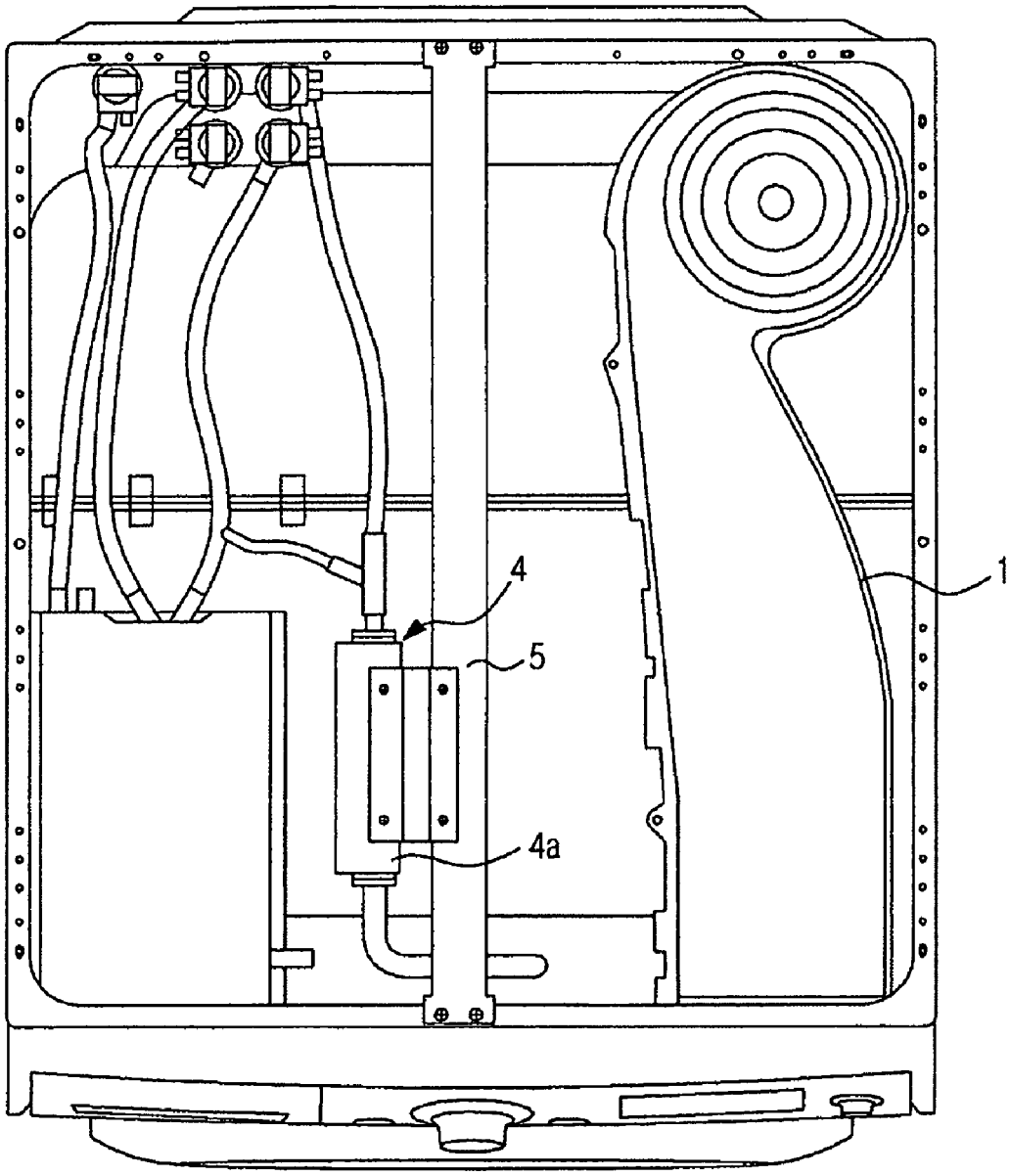

Reference will now be made in detail to the embodiments, examples of which are illustrated in the accompanying drawings, wherein like reference numerals refer to like elements throughout. The embodiments are described below to explain the present invention by referring to the figures.

Figure 3:
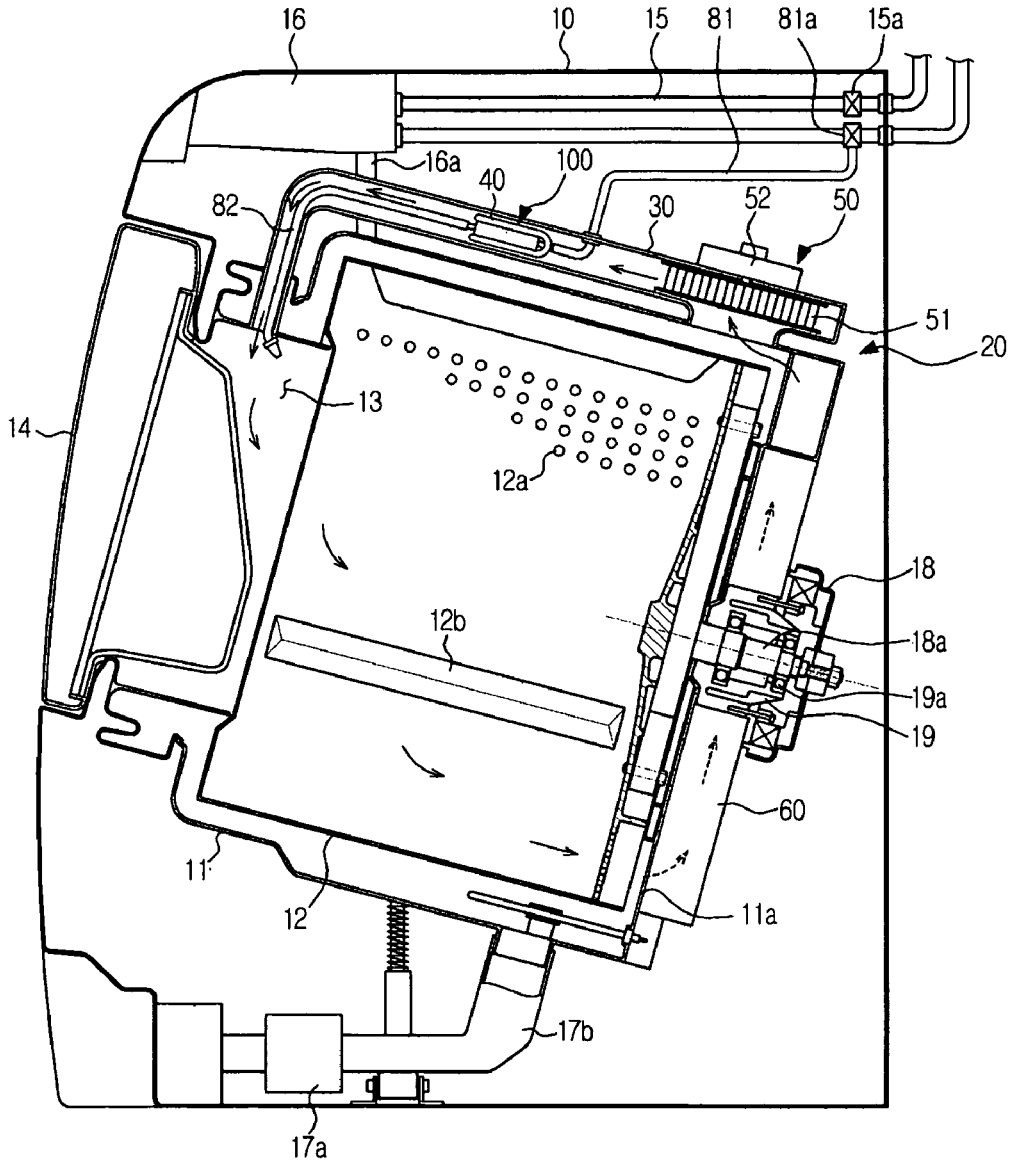
FIG. 3 is a sectional view illustrating the structure of a washing machine according to a first embodiment.
Figure 4:
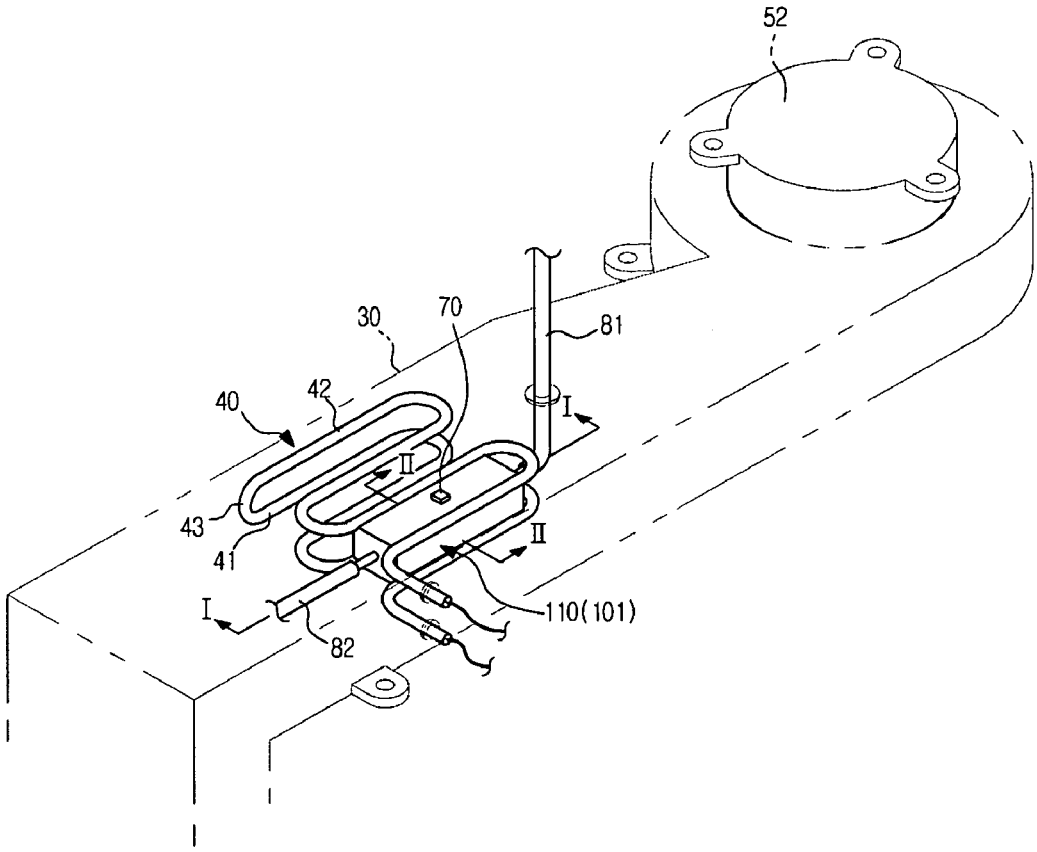
FIG. 4 is a perspective view illustrating a heating duct, a heater, and a steam generating part of FIG. 3.
Figure 5:
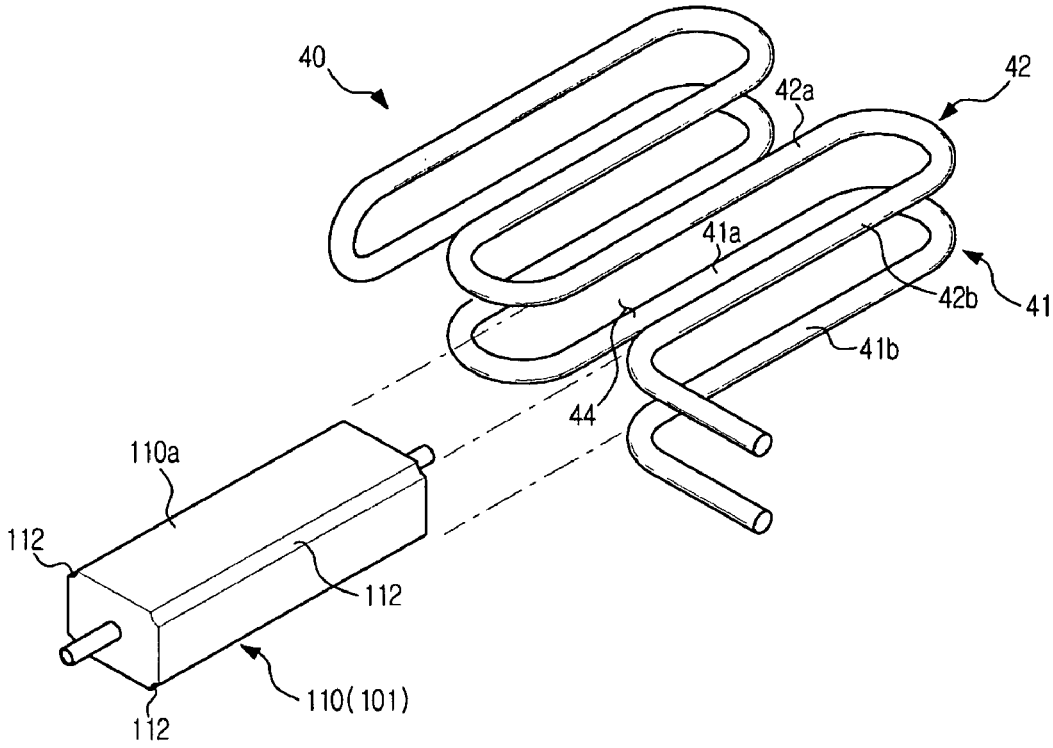
FIG. 5 is an exploded perspective view illustrating the coupling between the heater and the steam generating part of FIG. 4.

FIG. 3 is a sectional view illustrating the structure of a washing machine according to a first embodiment, FIG. 4 is a perspective view illustrating a heating duct, a heater, and a steam generating part of FIG. 3, and FIG. 5 is an exploded perspective view illustrating the coupling between the heater and the steam generating part of FIG. 4.

As shown in FIG. 3, the washing machine according to the present embodiment includes a machine body 10 forming an external appearance of the washing machine, a stationary tub 11 mounted in the machine body 10 to receive water, and a rotary tub 12 rotatably mounted in the stationary tub 11. In the front of the machine body 10 is formed a laundry inlet port 13, through which laundry is put in the rotary tub 12. To the front of the machine body is mounted a door 14 to open and close the laundry inlet port 13.

At an inside upper part of the machine body 10 are mounted a first water supply pipe 15 to supply wash water and a detergent supply unit 16 to supply detergent. On the first water supply pipe 15 is mounted a first water supply valve 15*a* to control the flow of water to the detergent supply unit 16. Between the detergent supply unit 16 and the stationary tub 11 is connected a connection pipe 16*a*, through which the water, having passed through the detergent supply unit 16, is supplied into the tub 11. At an inside lower part of the machine body 10 are mounted a drainage pump 17*a* and a drainage pipe 17*b* to discharge the wash water contained in the stationary tub 11 out of the machine body 10.

At the outside of the stationary tub 11 is mounted a drive motor 18 to rotate the rotary tub in alternating directions. Between the rotary tub 12 and the drive motor 18 is connected a rotary shaft 18*a* to transmit a rotary force from the drive motor 18 to the rotary tub 12. At a rear plate of the stationary tub 11 is mounted a bearing housing 19 to rotatably support the rotary shaft 18*a*. Between the bearing housing 19 and the rotary shaft 18*a* are mounted bearings 19*a*.

In the rotary tub 12 are formed a plurality of though-holes 12*a* to allow the flow of wash water. At the inner circumference of the rotary tub 12 are mounted a plurality of lifters 12*b* to raise and drop laundry during the rotation of the rotary tub 12.

As shown in FIGS. 3 and 4, the washing machine according to the present embodiment further includes a dryer 20 to supply hot air, necessary to dry laundry, into the rotary tub 12, and a steam generating part 100 to generate steam to be supplied to the rotary tub 12. According to the present embodiment, the steam generating part 100 does not use an additional heater to generate steam but receives heat from a heater 40, mounted in a heating duct 30, to generate steam.

The drier 20 includes a heating duct 30 defining a channel to supply hot air to the rotary tub 12, the heater 40 mounted in the heating duct 30, a blowing unit 50 to forcibly circulate air such that the hot air is supplied to the rotary tub 12, and a condensing duct 60 to remove moisture from the air having passed through the rotary tub 12.

The heating duct 30 is mounted on the stationary tub 11. One end of the heating duct 30 extends to the laundry inlet port 13 formed in the front of the machine body 10, such that the hot air is supplied into the rotary tub 12.

As shown in FIGS. 4 and 5, the heater 40 includes a first heater part 41 and a second heater part 42, which are arranged in parallel to each other, and a connection part 43 connected between the heater parts 41 and 42. The first heater part 41 has two heat emission pipes 41*a* and 41*b*, which are bent in a zigzag fashion such that the heat emission pipes 41*a* and 41*b* are adjacent to each other. The second heater part 42 is formed in a shape corresponding to the first heater part 41. The second heater part 42 is vertically connected to the first heater part 41 by the connection part 43. The shape of the heater 40 is basically decided in consideration of variables, such as the kind of an object to be heated by the heater, a space where the heater is mounted, and power consumption, for example. According to the present embodiment, the shape of the heater 40 is also decided in consideration of the installation structure of the steam generating part 100, because the steam generating part 100 generates steam using the heater 40 in the heating duct 30 without using an additional heater. Accordingly, the shape of the heater 40 shown in FIGS. 4 and 5 is only an illustrative example, and therefore, the shape of the heater 40 may be changed based on the installation structure of the steam generating part 100.

Referring back to FIG. 3, the blowing unit 50 includes a centrifugal blowing fan 51 mounted in the heating duct 30 and a fan motor 52 to drive the blowing fan 51. One end of the condensing duct 60 is connected to a hot air discharge port 11*a* formed in a lower part of a rear plate of the stationary tub 11, and the other end of the condensing duct 60 is connected to the heating duct 30. In the condensing duct 60 may be mounted a cooling water sprayer (not shown) to spray cooling water to cool air passing through the condensing duct 60.

Figure 6:
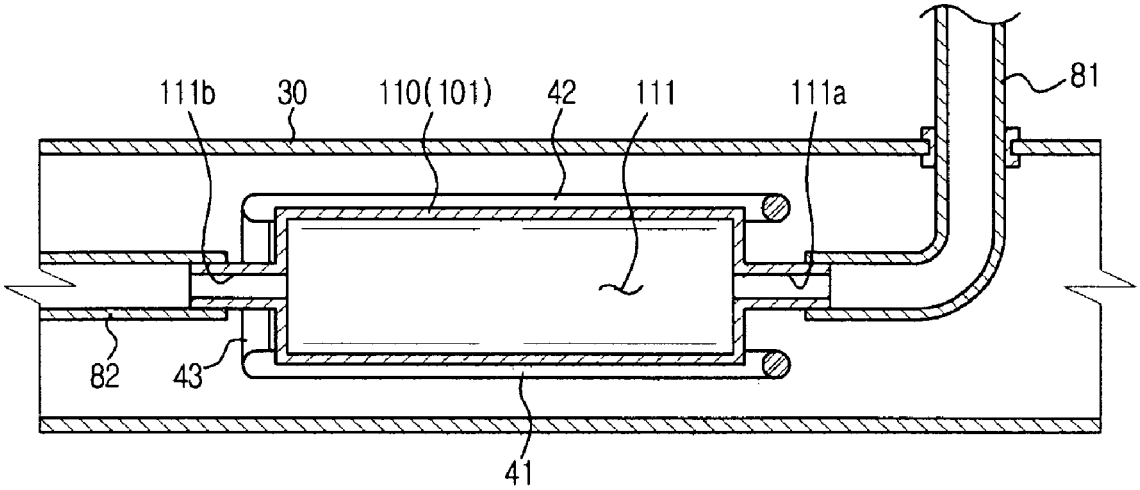
FIG. 6 is a sectional view taken along line I-I of FIG. 4.
Figure 7:
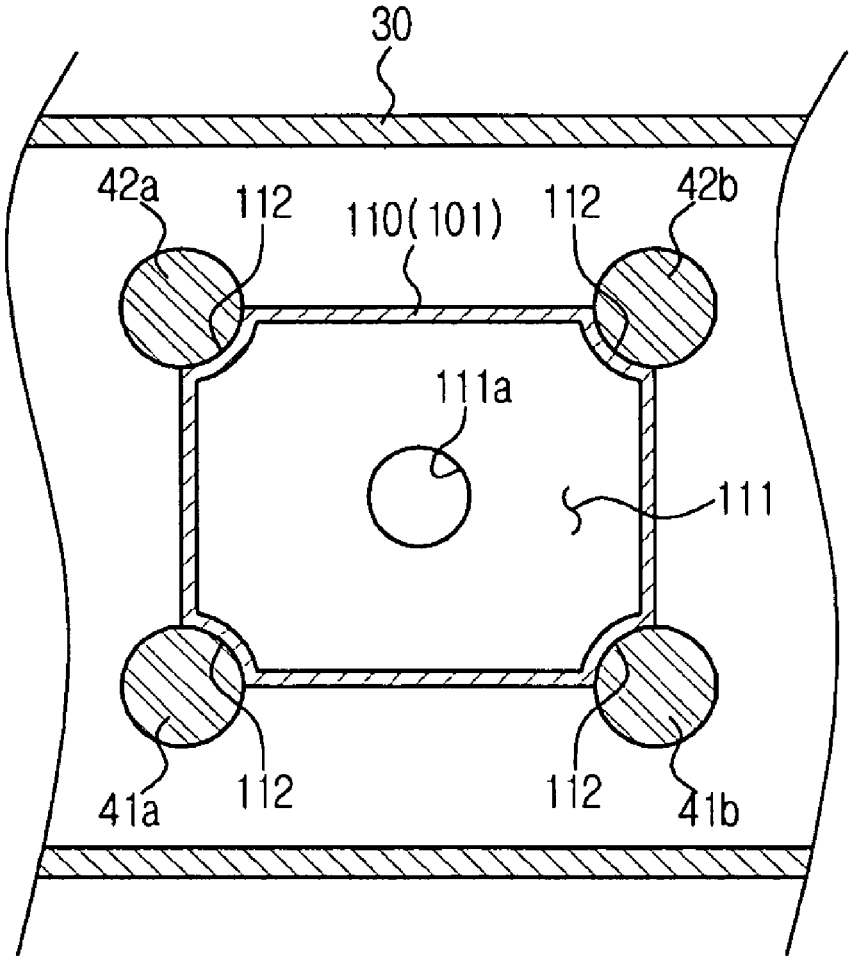
FIG. 7 is a sectional view taken along line II-II of FIG. 4.

FIG. 6 is a sectional view taken along line I-I of FIG. 4, and FIG. 7 is a sectional view taken along line II-II of FIG. 4.

As shown in FIGS. 4 to 7, the steam generating part 100 includes an object 101 to be heated, which is heated by contacting the heater 40. In this embodiment, an example in which a tubular member 110 is used as the object will be described.

The tubular object 110 is formed approximately in the shape of a rectangular parallelepiped. The tubular object 110 may be made of a metal casting product by aluminum die casting, for example. The object 110 has an outer surface 110*a* contacting the heater 40. In the object 110 is defined a hollow part 111 for steam generation. In the inlet of the hollow part 111 is formed a water supply port 111*a*. In the outlet of the hollow part 111 is formed a steam discharge port 111*b*. Water, introduced into the hollow part 111 through the water supply port 111*a*, is heated by the heater 40 with the result that the water is changed into steam. The steam, generated in the hollow part 111, is discharged through the steam discharge port 111*b*.

At the outer surface 110*a* of the object 110 is mounted a temperature sensor 70 (see FIG. 4). The temperature sensor 70 detects the temperature of the object 110 to control the heater 40. Specifically, when the temperature of the object 110 detected by the temperature sensor 70 exceeds a predetermined temperature level, a supply of current supplied to the heater 40 is interrupted.

The object 110 is fixedly inserted between the first heater part 41 and the second heater part 42, which are arranged in parallel to each other. More specifically, the object 110 is inserted in an object insertion region 44 defined between the two adjacent heat emission pipes 41*a* and 41*b* of the first heater part 41, between two adjacent heat emission pipes 42*a* and 42*b* of the second heater part 42, and between the first heater part 41 and the second heater part 42, which are vertically arranged, as shown in FIG. 5. When the dimension of the object 110 is designed such that the object 110 can be forcibly fitted in the object insertion region 44, it is possible to fix the object 110 to the heater 40 without using an additional fixing bracket.

At the outer surface 110*a* of the object 110, which contacts the heater 40, is formed heater receiving parts 112 or grooves to at least partially receive the heater 40. FIG. 7 illustrates an example in which four heater receiving parts 112 are provided to receive the two adjacent heat emission pipes 41*a* and 42*b* of the first heater part 41 and the two adjacent heat emission pipes 42*a* and 42*b* of the second heater part 42. The heater receiving parts 112 increase the contact area between the object 110 and the heater 40 such that heat from the heater 40 is effectively transmitted to the object 110. In addition, the heater receiving parts 112 assist the object 110 to be stably supported between the first heater part 41 and the second heater part 42.

In this embodiment, the object 110 is mounted in the heater 40 having the two heater parts 41 and 42, which are vertically arranged in parallel to each other, although the object 110 may be mounted in a heater 40 having only a single heater part. For example, the object 110 may be fitted between the two heat emission pipes 41*a* and 41*b* of the first heater part 41 such that the object 110 is fixed to the first heater part 41 only.

Also, as shown in FIGS. 3 and 6, the washing machine according to the present embodiment further includes a second water supply pipe 81 to supply water to the hollow part 111 of the object 110 and a steam supply pipe 82 to supply steam generated in the hollow part 111 into the rotary tub 12.

The second water supply pipe 81 extends into the heating duct 30 through the heating duct 30 and communicates with the water supply port 111*a* of the object 110. On the second water supply pipe 81 is mounted a second water supply valve 81*a* to control the flow of water supplied into the object 110. The second water supply pipe 81 is connected to the object 110, which is heated to a high temperature, and therefore, the second water supply pipe 81 is preferably made of a heat-resistant material, such as metal or heat-resistant rubber, for example. One end of the steam supply pipe 82 is connected to the steam discharge port 111*b* of the object 110, and the other end of the steam supply pipe 82 extends to the outlet of the heating duct 30, i.e., the laundry inlet port 13 in front of the rotary tub 12. When steam generated in the object 110 is directly discharged into the heating duct 30, which has a large inner capacity, the steam may be condensed during the supply of the steam into the rotary tub 12 through the heating duct 30. Furthermore, it is difficult for a user, seeing into the rotary tub 12 through the door 14 and the laundry inlet port 13, to visually confirm whether the steam is being properly supplied. Consequently, it is preferable for the steam supply pipe 82 to extend to the outlet of the heating duct 30.

Hereinafter, the operation of the washing machine according to this embodiment will be described with reference to FIGS. 3 to 7.

First, an operation of drying washed laundry will be described. When a drying operation is initiated, the blowing fan 51 and the heater 40 are operated to generate hot air. When only the hot air, and not steam, is supplied to the rotary tub 12, water is not supplied to the steam generating part 110. The generated hot air is supplied to the rotary tub 12 through the heating duct 30. The hot air supplied into the rotary tub 12 evaporates moisture contained in the laundry to dry the laundry. After the drying process is completed, the high-temperature, high-humidity air is discharged out of the rotary tub 12 through the through-holes 12*a*, and is then discharged into the condensing duct 60 through the hot air discharge port 11*a* of the stationary tub 11. The moisture contained in the air, introduced into the condensing duct 60, is removed while the air passes through the condensing duct 60. After the condensing process is completed, the air is reintroduced into the heating duct 30, and the above-described circulating process is repeatedly carried out.

Next, an operation of steam supply into the rotary tub 12 using the steam generating part 100 will be described. Steam, supplied to the rotary tub 12, may be used to soak dirt sticking to the laundry before the laundry is washed or to sterilize the laundry after the spin-drying of the laundry.

When the user selects a washing function using steam, the heater 40 is energized to heat the object 110 of the steam generating part 100. At this time, the supply of water to the object 110 is not performed for a predetermined period of time until the object 110 is sufficiently preheated. When it is determined through the temperature detection of the temperature sensor 70 that the object 110 is sufficiently heated to the predetermined temperature level or more, the second water supply pipe 81 is opened by the second water supply valve 81*a*, and water is supplied to the hollow part 111 of the object 110. The water, supplied into the object 110, is changed into steam by the heat emitted from the heated object 110. The steam is supplied into the rotary tub 12 through the steam supply pipe 82 due to its own pressure.

When only the steam is supplied into the rotary tub 12, it is not necessary to drive the blowing fan 51. If necessary, however, it is possible to drive the blowing fan 51 such that hot air is supplied to the rotary tub 12 together with the steam.

Figure 8:
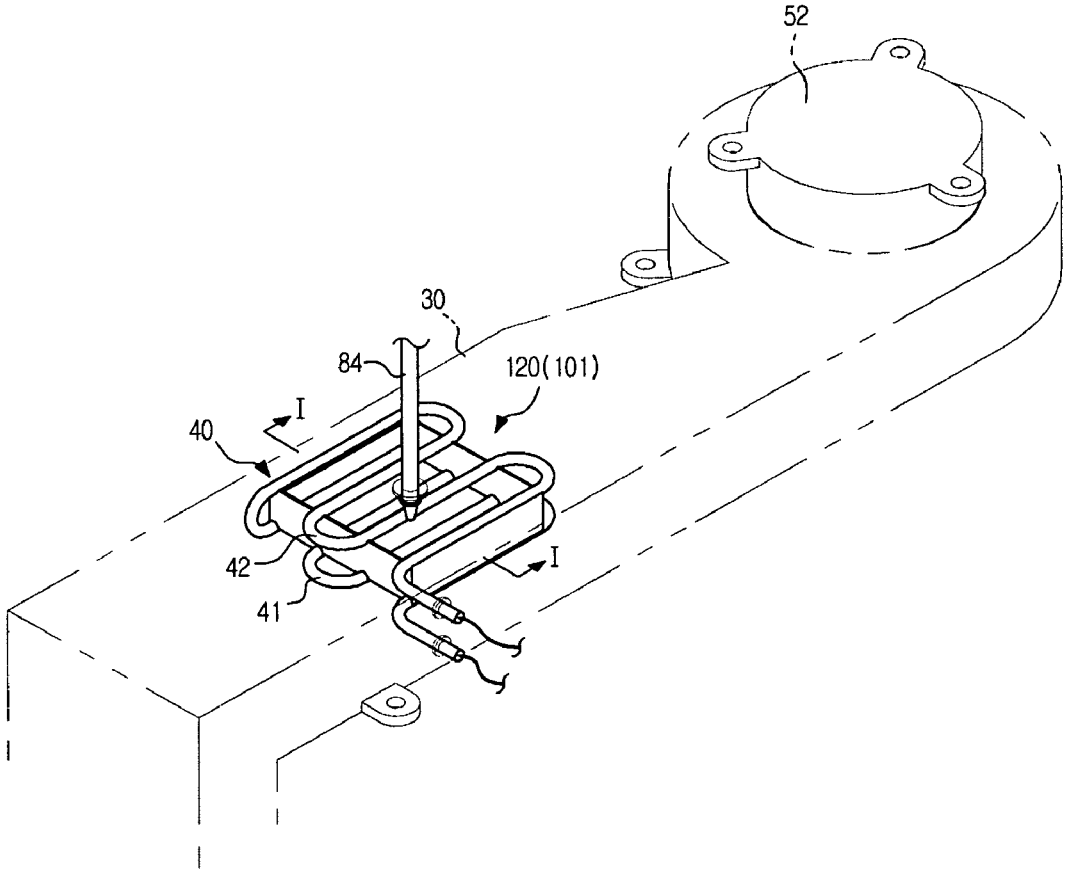
FIG. 8 is a perspective view illustrating a heating duct, a heater, and a steam generating part of a washing machine according to a second embodiment.
Figure 9:
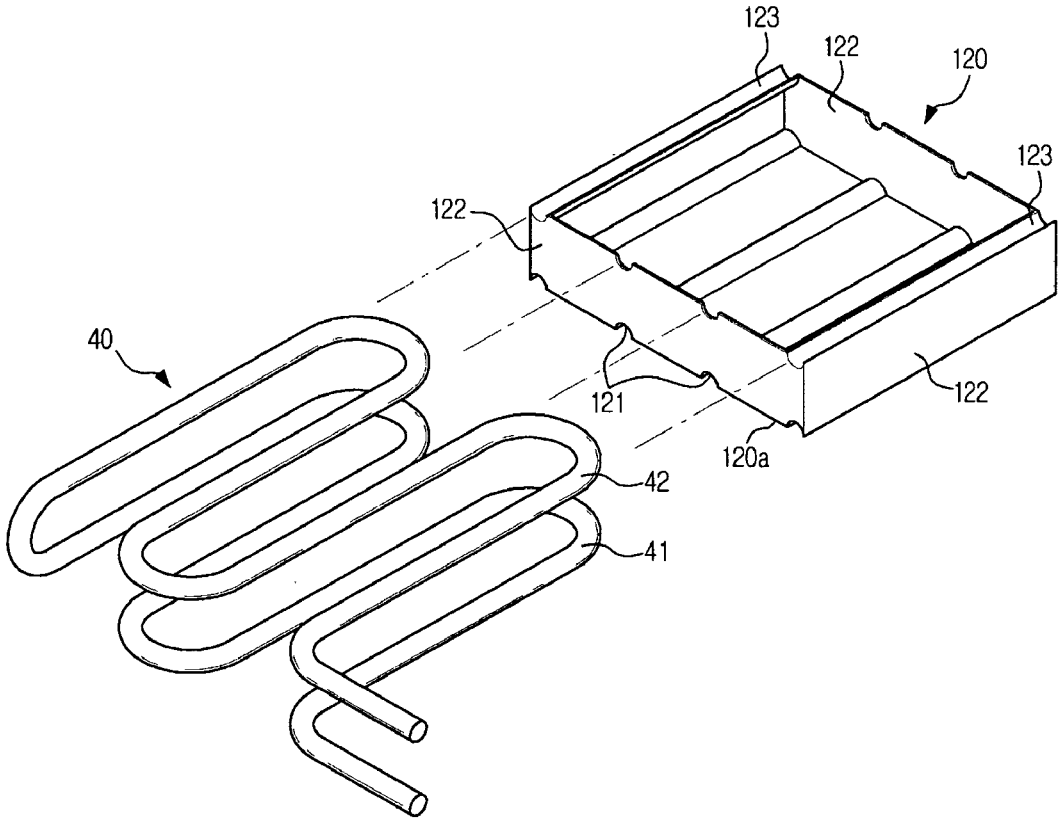
FIG. 9 is an exploded perspective view illustrating the coupling between the heater and the steam generating part of FIG. 8.
Figure 10:
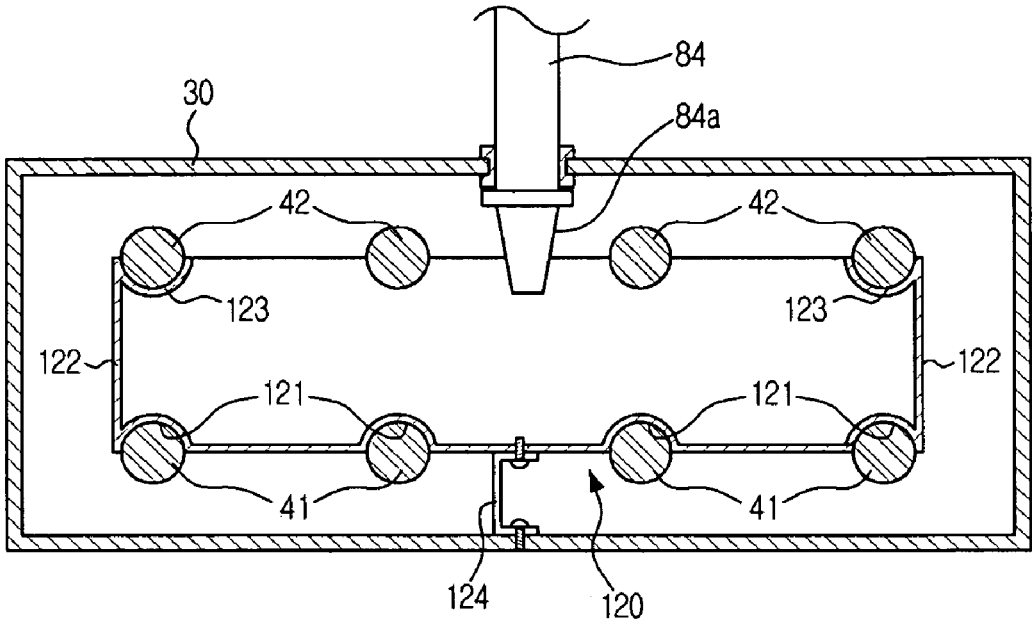
FIG. 10 is a sectional view taken along line I-I of FIG. 8.

FIG. 8 is a perspective view illustrating a heating duct, a heater, and a steam generating part of a washing machine according to a second embodiment, FIG. 9 is an exploded perspective view illustrating the coupling between the heater and the steam generating part of FIG. 8, and FIG. 10 is a sectional view taken along line I-I of FIG. 8.

Hereinafter, only the characteristics of this embodiment will be described, and components of this embodiment, which are common to those of the previous embodiment shown in FIGS. 3 to 5, will be denoted by the same reference numerals.

According to this embodiment, as shown in FIGS. 8 to 10, a steam generating plate 120, a bottom 120*a* of which contacts the heater 40, is used as the object 101. The steam generating plate 120 is constructed to receive water, which will be changed into steam. Water, supplied to the steam generating plate 120, is changed into steam by the heat emitted from the heater 40. The steam is supplied to the rotary tub 12 (see FIG. 3) through the heating duct 30.

The steam generating plate 120 is made of metal having a high thermal conductivity. The bottom 120*a* of the steam generating plate 120 is located at the first heater part 41 such that the steam generating plate 120 is disposed between the first heater part 41 and the second heater part 42. At the bottom 120*a* of the steam generating plate 120, which contacts the first heater part 41, is formed heater receiving parts 121 to receive, at least partially, the first heater part 41. The heater receiving parts 121 increase the contact area between the steam generating plate 120 and the first heater part 41 such that heat from the heater 40 is effectively transmitted to the steam generating plate 120. In addition, the heater receiving parts 121 assist the steam generating plate 120 to be stably supported at the first heater part 41.

The steam generating plate 120 includes bent parts 122 bent from the circumference thereof toward the second heater part 42 and heater support parts 123 formed at the bent parts 122 to receive the lower part of the second heater part 42. The bent parts 122 and the heater support parts 123 assist the steam generating plate 120 to be stably fixed to the heater 40 without using an additional bracket. Specifically, when the steam generating plate 120 is inserted between the first heater part 41 and the second heater part 42, which are vertically arranged, as shown in FIG. 9, movement of the steam generating plate 120 is prevented by the bent parts 122 and the heater support parts 123. Consequently, it is possible to easily fix the steam generating plate 120 to the heater 40 without using an additional bracket. Also, the bent parts 122, which are bent upward, prevent the water supplied to the steam generating plate 120 from dropping out of the steam generating plate 120. The heater support parts 123, contacting the second heater part 42, assist the steam generating plate 120 to more effectively receive the heat from the heater 40.

In this embodiment, the steam generating plate 120 is mounted between the first heater part 41 and the second heater part 42, which are vertically arranged in parallel to each other, although the steam generating plate 120 may be mounted in a heater 40 having only a single heater part.

Also, the washing machine according to this embodiment further includes a water supply pipe 84 to supply water to the steam generating plate 120. One end of the water supply pipe 84 extends into the heating duct 30 such that the end of the water supply pipe 84 is located above the steam generating plate 120. The other end of the water supply pipe 84 is connected to an external water source (not shown). On the water supply pipe 84 is mounted a water supply valve (not shown) to control the flow of water to the steam generating plate 120. To one end of the water supply pipe 84 is mounted a spray nozzle 84*a* to spray water to the steam generating plate 120.

As shown in FIG. 10, a support bracket 124 is mounted between the steam generating plate 120 and the heating duct 30. The support bracket 124 prevents the heater 40, to which the steam generating plate 120 is fixed, from drooping.

Hereinafter, the operation of the washing machine according to this embodiment will be described with reference to FIGS. 3 and 8 to 10.

When hot air is to be supplied to the rotary tub 12 to dry laundry, the heater 40 and the blowing fan 51 are operated. As a result, air heated by the heater 40 is supplied into the rotary tub 12 through the heating duct 30. At this time, water is not supplied to the steam generating plate 120, with the result that steam is not generated. However, the steam generating plate 120 serves as a heat sink to more effectively heat the air.

When steam is to be supplied to the rotary tub 12, the steam generating plate 120 is heated by the energization of the heater 40. At this time, the supply of water to the steam generating plate 120 is not performed for a predetermined period of time until the steam generating plate 120 is sufficiently preheated. After the steam generating plate 120 is sufficiently preheated, water is supplied to the steam generating plate 120 through the water supply pipe 84. The water, received in the steam generating plate 120, is changed into steam by the heat emitted from the heated steam generating plate 120. At this time, the water is sprayed over the large area of the steam generating plate 120 through the spray nozzle 84*a*, to rapidly generate steam. The generated steam is supplied into the rotary tub 12 through the heating duct 30. At this time, the steam may be supplied into the rotary tub 12 due to its own pressure. Alternatively, the blowing fan 51 may be driven at a low speed to forcibly move the steam.

Figure 11:
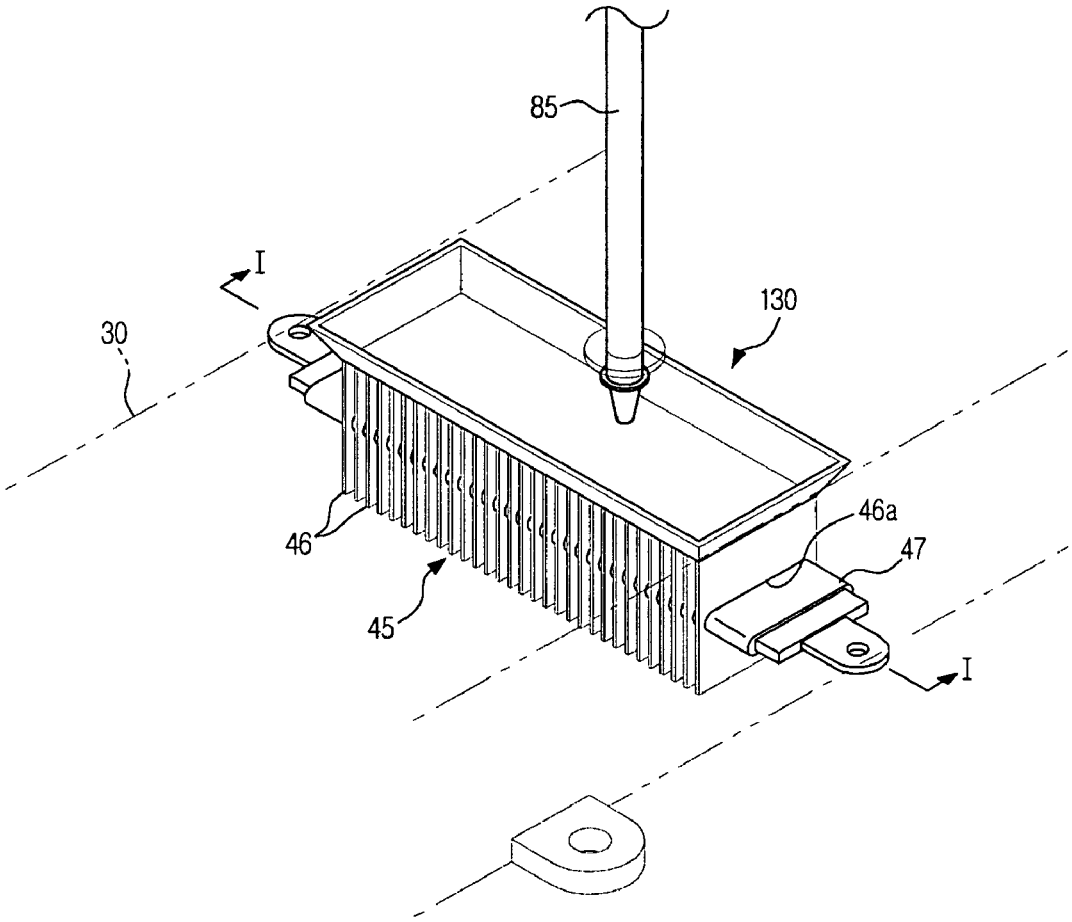
FIG. 11 is a perspective view illustrating a heating duct, a heater, and a steam generating part of a washing machine according to a third embodiment.
Figure 12:
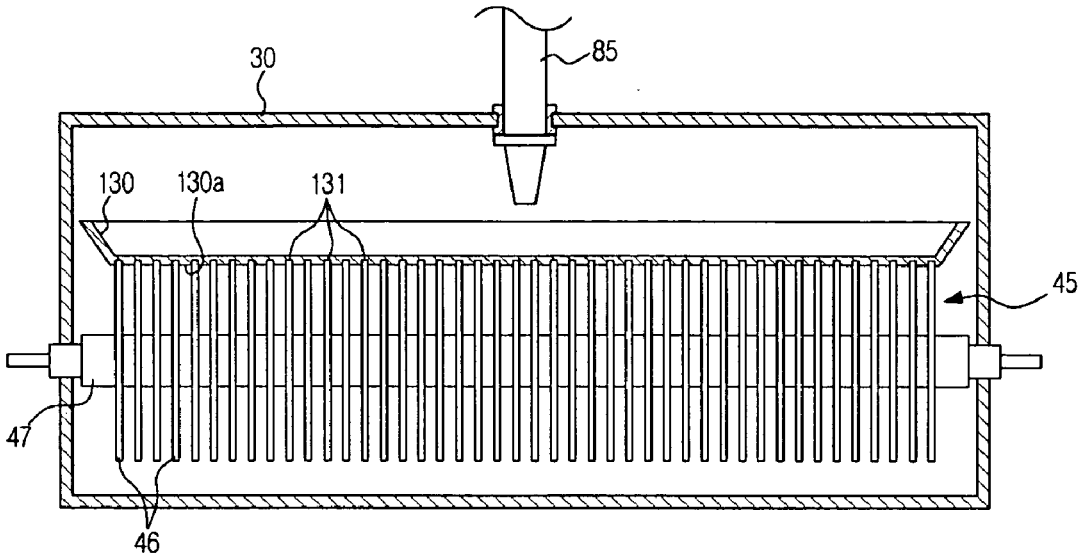
FIG. 12 is a sectional view taken along line I-I of FIG. 11.

FIG. 11 is a perspective view illustrating a heating duct, a heater, and a steam generating part of a washing machine according to a third embodiment, and FIG. 12 is a sectional view taken along line I-I of FIG. 11. FIGS. 3 to 10 illustrate examples using the pipe-type heater, whereas this embodiment illustrates an example using a positive temperature coefficient (PTC) heater. Hereinafter, only the characteristics of this embodiment will be described.

As shown in FIGS. 11 and 12, a PTC heater 45 is used as the heater mounted in the heating duct 30. The PTC heater 45 includes a plurality of heat dissipation fins 46 arranged in parallel to one another and a PTC heating rod 47 penetrating the heat dissipation fins 46. Each heat dissipation fin 46 has a through-hole 46*a* formed in the center thereof. The PTC heating rod 47 is inserted through the through-holes 46*a* of the heat dissipation fins 46.

On the heat dissipation fins 46 of the PTC heater 45 are mounted a steam generating plate 130 as the object 101 of the steam generating part 100. The steam generating plate 130 is made of metal having a high thermal conductivity. The bottom 130*a* of the steam generating plate 130 contacts the heat dissipation fins 46 such that heat from the heat dissipation fins 46 is transmitted to the steam generating plate 130. As shown in FIG. 12, the steam generating plate 130 has heater receiving parts 131 to receive one-side ends of the heat dissipation fins 46. The heater receiving parts 131 increase the contact area between the steam generating plate 130 and the heat dissipation fins 46 such that heat from the PTC heater 45 is effectively transmitted to the steam generating plate 130.

Above the steam generating plate 130 is mounted a water supply pipe 85 to supply water into the steam generating plate 130. Consequently, when water is supplied to the steam generating plate 130, which is heated by the PTC heater 45, steam is generated from the steam generating plate 130. The generated steam is supplied into the rotary tub 12 (see FIG. 3) through the heating duct 30.

As apparent from the above description, the washing machine according to the present embodiments is capable of generating steam to be supplied to the rotary tub without using an additional exclusive heater. Consequently, the present embodiments have the effect of reducing the material costs. Also, it is possible to reduce the volume of the steam generating part. Consequently, the present embodiments have the effect of more effectively utilizing the inner space of the washing machine.

Furthermore, the steam generating part is heated in the heating duct while the steam generating part is isolated from the components around the steam generating part by the heating duct. Consequently, it is possible to prevent the components around the steam generating part from being damaged by heat transmitted from the steam generating part.

Although a few embodiments have been shown and described, it would be appreciated by those skilled in the art that changes may be made in this embodiment without departing from the principles and spirit of the invention, the scope of which is defined in the claims and their equivalents.

What is claimed is:

1. A washing machine, comprising:

a rotary tub to receive laundry;

a heater mounted on a channel to supply hot air to the rotary tub; and a steam generating part heated by the heater to generate steam, wherein the steam generating part includes an object heated by the heater, wherein the heater includes a first heater part and a second heater part, and wherein the object is inserted between the first heater part and the second heater part such that an upper surface of the object contacts the first heater part, and a lower surface of the object contacts the second heater part.

2. The washing machine according to claim 1, further comprising:

a heating duct defining the channel.

3. The washing machine according to claim 1, wherein the object includes a tubular member having a hollow part for steam generation defined therein.

4. The washing machine according to claim 3, further comprising:

a water supply pipe extending into the channel such that the water supply pipe is connected to the hollow part; and a steam supply pipe having one end connected to the hollow part.

5. The washing machine according to claim 4, wherein an other end of the steam supply pipe extends to an outlet of the channel.

6. The washing machine according to claim 3, wherein the tubular member is provided at the outer surface thereof with heater receiving parts to partially receive the heater such that the contact area between the tubular member and the heater is increased.

7. The washing machine according to claim 3, wherein the tubular member is provided with a plurality of grooves located on an upper and lower surface of the tubular member to support the first heater part and the second heater part.

8. The washing machine according to claim 3, wherein the first heater part includes at least two adjacent heat emission pipes, and the second heater part includes at least two adjacent heat emission pipes, and the tubular member is inserted between the heat emission pipes of the first and second heater parts.

9. The washing machine according to claim 1, wherein the object includes a steam generating plate having an upper surface and a lower surface heated by the heater.

10. The washing machine according to claim 9, further comprising:

a water supply pipe extending into the channel such that one end of the water supply pipe is located above the steam generating plate.

11. The washing machine according to claim 10, further comprising:

a spray nozzle mounted to the end of the water supply pipe.

12. The washing machine according to claim 9, wherein the steam generating plate includes heater receiving parts provided at an outer surface thereof, to partially receive the heater such that the contact area between the steam generating plate and the heater is increased.

13. The washing machine according to claim 9, wherein the bottom surface of the steam generating plate contacts the first heater part, the top surface of the steam generating plate contacts the second heater part, and the steam generating plate includes bent parts bent toward the second heater part and heater support parts formed at the bent parts to support the second heater part.

14. The washing machine according to claim 9, further comprising a support bracket mounted between a bottom surface of the steam generating plate and the channel.

15. The washing machine according to claim 1, further comprising:

a blowing unit to supply hot air or steam to the rotary tub.

16. A washing machine, comprising:

a rotary tub;

a heating duct connected to the rotary tub;

a steam generating part disposed in the heating duct; and a heater to heat air in the heating duct such that hot air is supplied to the rotary tub, or to heat the steam generating part such that steam is supplied to the rotary tub, wherein the steam generating part includes an object heated by the heater, wherein the heater includes a first heater part and a second heater part, and wherein the object is inserted between the first heater part and the second heater part such that an upper surface of the object contacts the first heater part, and a lower surface of the object contacts the second heater part.

17. The washing machine according to claim 16, wherein the object receives water to be heated.

18. A washing machine, comprising:

a rotary tub;

a dryer including a heating duct and a heater mounted in the heating duct, the dryer supplying hot air into the rotary tub;

a tubular object to be heated, which is mounted in the heating duct such that the object is heated by the heater; and a water supply pipe extending into the heating duct to communicate with the object, wherein the heater includes a first heater part and a second heater part, and wherein the object is inserted between the first heater part and the second heater part such that an upper surface of the object contacts the first heater part, and a lower surface of the object contacts the second heater part.

19. The washing machine according to claim 18, wherein the first heater part and the second heater part are arranged in parallel to each other, and the object is fixedly inserted between the first heater part and the second heater part.

20. A washing machine, comprising:

a rotary tub;

a dryer, including a heating duct and a heater mounted in the heating duct, to supply hot air into the rotary tub;

a plate-shaped object to be heated, which is mounted in the heating duct such that the object is heated by the heater; and a water supply pipe having one end located above the object, wherein the heater includes a first heater part and a second heater part, and wherein the object is inserted between the first heater part and the second heater part such that an upper surface of the object contacts the first heater part, and a lower surface of the object contacts the second heater part.

21. The washing machine according to claim 20, wherein the first heater part and the second heater part are vertically arranged in parallel to each other, and the object includes at least one concave-shaped groove at the bottom surface to contact the first heater part and at least one concave-shaped groove at the top surface to contact the second heater part.

22. A washing machine, comprising:

a rotary tub to receive laundry;

a heater supplying hot air to the rotary tub; and a steam generating object disposed adjacent to and heated by the heater to generate steam, wherein the heater includes a first heater part and a second heater part, and wherein the object is inserted between the first heater part and the second heater part such that an upper surface of the object contacts the first heater part, and a lower surface of the object contacts the second heater part.

23. The washing machine according to claim 22, wherein the steam generating object includes at least one heater receiving groove receiving a portion of the heater.

24. The washing machine according to claim 23, wherein the at least one heater receiving groove is disposed at a bottom or a top of the steam generating object.

25. The washing machine according to claim 22, further comprising a water supply pipe supplying water onto a surface of the steam generating object.

26. The washing machine according to claim 25, wherein the water supply pipe is disposed at one of a side of the steam generating object to supply water into the steam generating object or above the steam generating object to supply water onto at least one surface of the steam generating object.

* * * * *